US005884828A

United States Patent [19]

Hirtl et al.

[11] Patent Number: 5,884,828

[45] Date of Patent: Mar. 23, 1999

[54] FASTENING ELEMENT SETTING TOOL WITH SHOCK DAMPER

[75] Inventors: Anton Hirtl, Gams; Norbert Pfister, Montlingen, both of Switzerland

[73] Assignee: Hilti Aktiengesellschaft, Schaan, Liechtenstein

[21] Appl. No.: 756,511

[22] Filed: Nov. 26, 1996

[30] Foreign Application Priority Data

Nov. 27, 1995 [DE] Germany ..... 195 44 105.2

[51] Int. Cl.[6] ..... B25C 1/14

[52] U.S. Cl. ..... 227/10; 173/212

[58] Field of Search ..... 227/9, 10, 11, 227/130; 173/212, 162.2

[56] References Cited

U.S. PATENT DOCUMENTS

| | | | |
|---|---|---|---|
| 3,064,262 | 11/1962 | Kopf et al. | 227/10 |
| 3,348,751 | 10/1967 | Henning . | |
| 4,711,385 | 12/1987 | Jochum | 227/10 |
| 4,883,211 | 11/1989 | Philipp et al. | 227/9 |
| 5,170,922 | 12/1992 | Ehmig et al. | 227/10 |
| 5,213,247 | 5/1993 | Gschwend et al. | 227/10 |
| 5,220,123 | 6/1993 | Oehry | 227/10 |
| 5,653,370 | 8/1997 | Bereiter et al. | 227/10 |

FOREIGN PATENT DOCUMENTS

| | | |
|---|---|---|
| 0309204 | 9/1988 | European Pat. Off. . |
| 0331168 | 3/1989 | European Pat. Off. . |

*Primary Examiner*—Scott A. Smith
*Attorney, Agent, or Firm*—Anderson, Kill & Olick, P.C.

[57] ABSTRACT

An explosive powder charge operated setting tool includes a housing (1), a handle (2) located on the housing, a piston guide (4) and a firing pin guide (8) each located within and being axially displaceable relative to the housing against the force of a damping device (17) bearing against a trailing end stop face within the housing directed in the driving direction. The housing (1) forms an axially extended receiving space (24) for guiding the piston guide (4). The receiving space has an axial length (LA) between a leading end face of the housing and a leading end face of the firing pin guide in a first position. The piston guide (4) has an axial length (LK) coinciding at the most with the axial length (LA) of the receiving space.

4 Claims, 1 Drawing Sheet

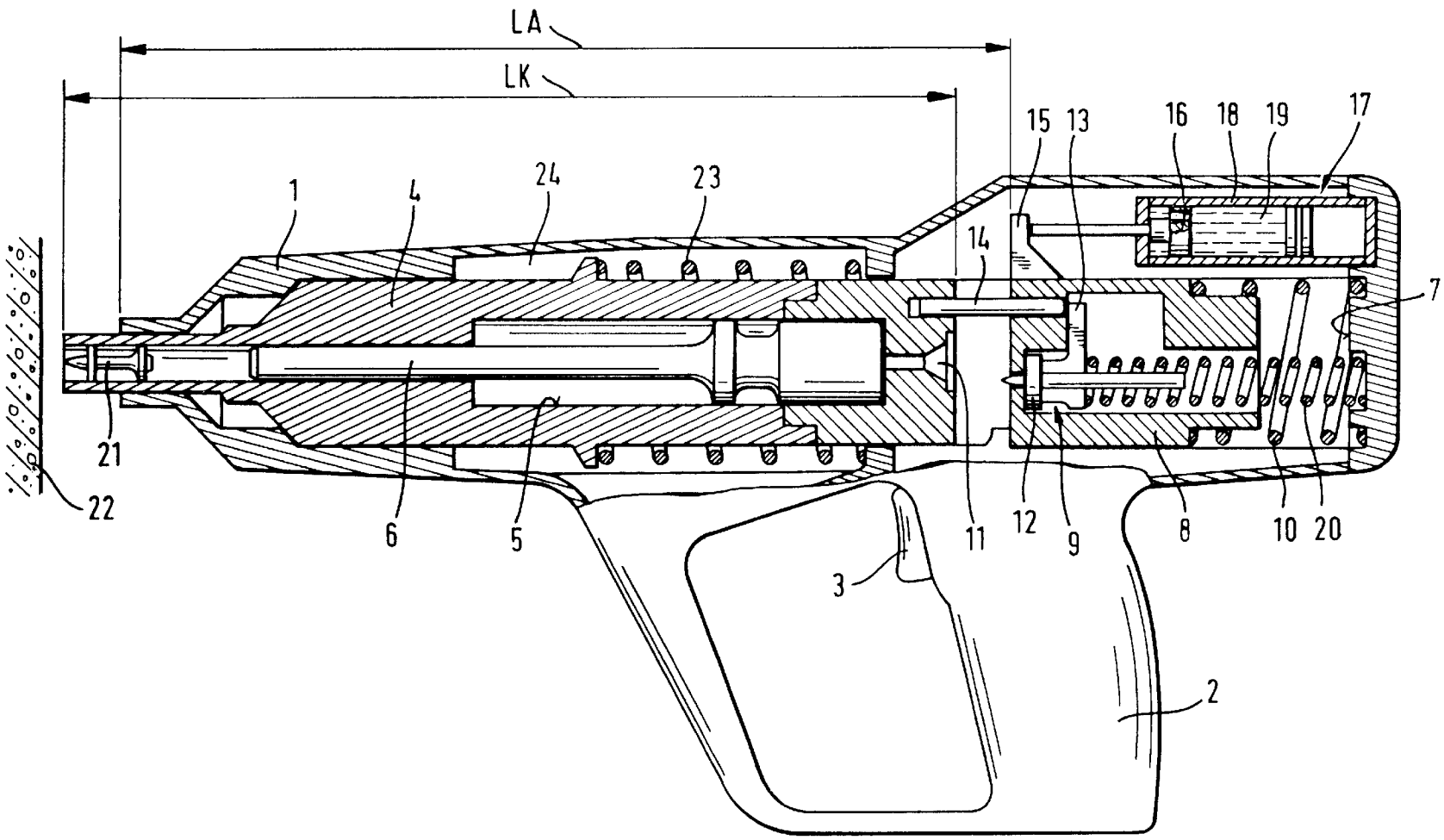
7
17
20
19
10
18
16
8
2
13
9
15
12
14
11
3
23
LA
LK
24
5
4
6
1
21
22

FASTENING ELEMENT SETTING TOOL WITH SHOCK DAMPER

BACKGROUND OF THE INVENTION

The present invention is directed to an explosive powder charge operated setting tool having a housing equipped with a handle, a piston guide is axially displaceable within and relative to the housing against the force of a spring. A firing pin guide is also located within the housing rearwardly of the piston guide. The firing pin guide is axially displaceable relative to the housing and cooperates with a damping device bearing against a stop face at the trailing end of the housing and directed facing in the driving direction.

An explosive counter-charge operated setting tool is disclosed in EP-O 331 168 A1 which serves for driving fastening elements, such as nails, bolts, studs and the like, into hard receiving materials. A piston guide and a firing pin guide are located within a housing with the firing pin guide located behind the piston guide and both are axially displaceable relative to the housing. The housing includes a handle. The piston guide is displaceable against the force of a spring and the firing pin guide is displaceable against the force of a damping device bearing against a trailing end stop face in the housing. The piston guide projects axially outwardly from a leading end face of the housing and includes a driving piston moveable in a guide bore within the piston guide.

A cartridge chamber is located in a trailing end region of the piston guide facing the firing pin guide. The chamber is arranged to hold an explosive powder cartridge. A firing mechanism located in the firing pin guide includes a firing pin axially displaceable against the force of a spring element. When the setting tool is pressed against a receiving material, the piston guide moves in its axial direction opposite to the driving direction until it rests against the firing pin guide. As a result, the spring element and a spring disposed between the piston guide and the housing are prestressed or preloaded.

If an operating trigger located in the handle is depressed, the firing pin is accelerated in the direction of the cartridge charge by the preloaded spring element and it ignites the cartridge. The propellant gas pressure developed in ignition of the cartridge accelerates the piston guide and the firing pin guide opposite to the driving direction and the driving piston is accelerated in the guide bore of the piston guide in the driving direction, so that the driving piston drives a fastening element located in the muzzle region of the piston guide into the receiving material. The acceleration of the piston guide and the firing pin guide relative to the housing and opposite to the driving direction is damped by the shock absorbing device.

If the pressure developed in the driving operation is great, an axial displacement of the firing pin relative to the housing takes place during the driving operation. This entails at least a partial compression of the damping device. During the subsequent driving operation, the damping device is no longer able to sufficiently damp out the rebound force acting on the housing or the handle. Accordingly, there ia a danger of injury to the tool operator.

SUMMARY OF THE INVENTION

Therefore, the primary object of the present invention is to provide an explosive powder charge operated setting tool which assures the reliable operation of the damping device independently of the magnitude of the force developed when the fastening element is driven. Further, the high level of comfort is afforded the tool operator and the setting tool can be manufactured simply and economically.

In accordance with the present invention, the housing is provided with a receiving space in which the piston guide is guided with the axial length of the piston guide corresponding at the most to the axial length of the receiving space extending between a leading end face of the housing and a leading end face of the firing pin guide in a first position.

The receiving space for the piston guide has an axial length extending from the leading end face of the housing to the leading end face of the firing pin guide before it is displaced. The piston guide is axially displaceable in the receiving space at most for the length of the receiving space. In the course of the driving operation, the piston guide initially projects outwardly from the leading end face of the housing and is moved opposite to the firing direction into the receiving space until the leading end face of the piston guide is located in the same plane as the leading end face of the housing. If the firing pin guide is to afford a sealing action for the cartridge chamber located in a trailing end of the piston guide, then the axial length of the piston guide coincides preferably to the axial length of the receiving space. When the piston guide is displaced rearwardly, it comes to rest at the leading end face of the piston guide without compressing the damping device.

An approximately constant damping force is preferably obtained with the damping device formed by a cylinder containing a liquid medium subjected to gas pressure and a pressure piston containing throttling openings. Due to the weight distribution considerations in the setting tool, the pressure piston cooperates with the piston guide and affords cooperation of the cylinder with a trailing end stop face of the housing.

BRIEF DESCRIPTION OF THE DRAWINGS

The drawing is a side elevational view partially in section of an explosive powder charge operated setting tool embodying the present invention.

DETAILED DESCRIPTION OF THE INVENTION

The explosive powder charge operated setting tool embodying the present invention is shown in the drawing in an at rest position and is used for fastening elements 21, such as nails, bolts, studs, and the like, into hard receiving materials 22. As viewed in the drawing, the setting tool has a leading end at the left-hand side and a trailing end at the right-hand side, with the driving direction of the tool being from the trailing end toward and through the leading end. The tool comprises a housing 1 with a handle 2 intermediate in its ends and extending downwardly from it. An operating switch or trigger 3 is located in the handle. An axially extending piston guide 4 with an axially extending guide bore 5 for a driving piston 6 axially displaceable in the bore, is located in the housing. A firing pin guide 8 of a firing mechanism 9 is located in the housing rearwardly of the piston guide 4. The piston guide 4 and the firing pin guide 8 are axially displaceable relative to the housing 1.

The firing pin guide 8 is displaceable against the force of a resetting member 10 bearing against the firing pin guide and a stop face 7 at the trailing end of the housing directed in the driving direction. A cartridge chamber 11 is located in a trailing end region of the piston guide 4 facing the firing pin guide and the cartridge chamber 11 is arranged to receive a cartridge containing a propellant explosive powder charge, not shown.

The firing mechanism 9 is formed of an axially extending firing pin 12 located in the firing pin guide with an entrainment cam 13 laterally surrounding the firing pin and extending laterally from it. Further, a spring element 20 bears against the stop face 7 on the housing at its trailing end and against the entrainment cam 13 at its leading end. The entrainment cam 13 extends laterally into the axial projection of an entrainment stud 14 supported in the firing pin guide 8 and cooperating with the piston guide 4.

As viewed in the drawing, an entrainment device 15 extends laterally from the upper side of the firing pin guide 8 and the device extends into the axial projection of a pressure piston 16 containing throttling openings, note the drawing. A damping device 17 includes and axially extending cylinder 18 containing a trailing end or head of the pressure piston 16 with the shaft of the pressure piston 16 extending forwardly in a driving direction out of the cylinder. Within the cylinder 18 a liquid medium 19 is subjected to gas pressure.

The damping device 17 along with the spring 10 and the spring element 20 cooperate with the firing pin 12 and abut against the stop face 7 at the trailing end of the housing 1. Prior to the driving operation, a fastening element 21 is inserted into the muzzle end of the piston guide 4 and the setting tool is prepared for ignition.

In such preparation, the leading end of the piston guide 4 projecting forwardly of the leading of the housing 1 is pressed against the receiving material 22 so that the piston guide moves opposite to the firing direction into the receiving space 24 in the housing and the pressure spring 23 laterally surrounding the piston guide is prestressed. The entrainment stud 14 extending between the piston guide 4 and the entrainment cam 13 of the firing pin 12 presses the firing pin into a position ready for ignition and the spring element 20 cooperating with the firing pin is compressed.

In this arrangement of the setting tool, the piston guide 4 is displaced axially against the leading end face of the firing pin guide 8 with the leading end of the firing pin guide being in a first position and it rests at the damping device 17. When the operating trigger 3 is depressed, the firing pin 12 is displaced out of the axial projection of the entrainment stud 14, is accelerated in the driving direction and ignites the cartridge located in the cartridge chamber. As a result, the explosive powder charge generates a propellant gas and accelerates the driving piston 6, in the guide bore 5 of the piston guide 4, in the driving direction and also accelerates the piston guide 4 and the firing piston guide 8 opposite to the driving direction. The fastening element 21 located in the muzzle end of the piston guide is driven by the driving piston 6 into the receiving material 22. The damping device 17 responds immediately at the start of the acceleration so that the strength of the rebound is damped to such an extent that no great force acts on the tool operator.

The resetting element or spring 10 acts parallel to the damping device 17 and extends between the firing pin guide 8 and the stop face 7 and moves the firing pin guide, after the end of the driving operation back into its original or first position until it rest at a stop in the housing located between the piston guide 4 and the firing pin guide 8. The damping device 17, cooperating with a firing pin guide 8, also reaches its initial or original position. The driving piston 6 is returned to its original position within the guide bore 5 by means of the pressure spring 23 laterally surrounding the piston guide 4.

While specific embodiments of the invention have been shown and described in detail to illustrate the inventive principles, it will be understood that the invention may be embodied otherwise without departing from such principles.

What is claimed as new and desired to be protected by letters patent is set forth in the appended claims.

What is claimed is:

1. An explosive powder charge operated setting tool comprises a housing (1) having a leading end and a trailing end and a driving direction extending in the trailing end through the leading end direction, a handle (2) being located in a trailing end region of said housing, an axially extending piston guide (4) being axially displaceable in said housing relative to the driving direction against the force of a first spring, and an axially extending firing pin guide (8) located within said housing between a trailing end of said piston guide and the trailing end of said housing and extending in the driving direction, said firing pin guide (8) being axially displaceable within said housing relative to the driving direction from a first position to a second position spaced opposite to the driving direction from said first position, a damping device (17) located within said housing and cooperating with said firing pin guide, said damping device (17) having a trailing end abutting a stop face (7) in said housing and said stop face facing in the driving direction, said housing (1) having an axially extending receiving space (24) in a leading end region thereof for guiding said piston guide (4), said piston guide having an axial length (LK) in the driving direction coinciding at the most to an axial length (LA) of said receiving space extending between a leading end face of said housing and a leading end face of said firing pin guide (8) in the first position thereof.

2. An explosive powder charge operated setting tool, as set forth in claim 1, wherein the axial length (LK) of said piston guide coincides with the axial length (LA) of said receiving space (24).

3. An explosive powder charge operated setting tool, as set forth in claim 1 or 2, wherein said dampening device comprises an axially extending cylinder (18) with the axis thereof extending parallel to the driving direction, said cylinder contains a liquid medium (19) subjected to gas pressure and an axially extending pressure piston (16) having a head within said cylinder and a shaft extending from said head in the driving direction out of said cylinder, and said head having a throttling opening therethrough.

4. An explosive powder charge operated setting tool, as set forth in claim 3, wherein said pressure piston (16) cooperates with said firing pin guide (8) and said axially extending cylinder (18) containing said pressure piston (16) bears at a trailing end thereof against said stop face (7) at the trailing end of said housing (1).

* * * * *